US006729498B2

(12) United States Patent
Yelton et al.

(10) Patent No.: US 6,729,498 B2
(45) Date of Patent: May 4, 2004

(54) DISPENSER FOR WIPES

(75) Inventors: Donald William Yelton, Villa Hills, KY (US); Gary Gerard Fores, Sea Cliff, NY (US); Ernest Accuco Pedicano, New Rochelle, NY (US)

(73) Assignee: The Procter & Gamble Company, Cincinnati, OH (US)

( * ) Notice: Subject to any disclaimer, the term of this patent is extended or adjusted under 35 U.S.C. 154(b) by 157 days.

(21) Appl. No.: 10/163,110

(22) Filed: Jun. 5, 2002

(65) Prior Publication Data

US 2003/0006253 A1 Jan. 9, 2003

Related U.S. Application Data

(60) Provisional application No. 60/302,265, filed on Jun. 29, 2001.

(51) Int. Cl.[7] ..... B65H 1/00
(52) U.S. Cl. ..... 221/63; 206/494
(58) Field of Search ..... 221/45, 53, 62, 221/63, 307, 310; 206/812, 449, 494; 220/260, 281

(56) References Cited

U.S. PATENT DOCUMENTS 3,982,659 A 9/1976 Ross
5,582,294 A 12/1996 Yamada
5,699,912 A 12/1997 Ishikawa et al.
6,152,322 A 11/2000 Marino

FOREIGN PATENT DOCUMENTS

| | | |
|---|---|---|
| DE | 200 00 604 U1 | 4/2000 |
| EP | 0 955 248 A1 | 11/1999 |
| JP | 2000-211680 | 8/2000 |
| WO | WO98/19934 | 5/1998 |

OTHER PUBLICATIONS

International Search Report for PCT/US02/20800, date of mailing Dec. 12, 2002.

*Primary Examiner*—Kenneth W. Noland
(74) *Attorney, Agent, or Firm*—Vladimir Vitenberg; David K. Mattheis; David M. Weirich

(57) ABSTRACT

A dispenser for wipes. The present dispenser comprises a unitary living hinge and a pop-up cover. The unitary hinge allows for simplicity of construction, processing, and use. It also eliminates the need for a secondary mechanical hinge. The pop-up cover permits easy one-handed wipe dispensing without requiring that the lid be manually held in an open position.

7 Claims, 11 Drawing Sheets

DISPENSER FOR WIPES

CROSS REFERENCE TO RELATED APPLICATION

This application claims the benefit of U.S. Provisional Application No. 60/302,265 filed Jun. 29, 2001.

FIELD OF THE INVENTION

This invention relates to a dispenser for wipes which features a pop-up cover and pop-up wipes capability.

BACKGROUND OF THE INVENTION

One of the limitations of prior art wipe dispensers is that a single dispenser requires several different materials to construct the dispenser. For instance, the body of the dispenser may be made of one material, the lid of a second different material, and the hinge connecting the dispenser body to the lid of yet a third material. This adds complexity to the dispenser manufacturing process.

Furthermore, the hinge is commonly comprised of some type of mechanical device such as a spring, a strap, or other like elastic material. Such devices are disclosed in EP 0952088 published on Oct. 27, 1999 and in U.S. Pat. No. 5,699,912 issued to Ishikawa et al. on Dec. 23, 1997. The drawback of these types of mechanical hinging devices is that they are subject to mechanical failure. Additionally, these types of mechanical hinging devices add further complexity to the dispenser manufacturing.

Another common limitation of prior art wipes dispensers is that the wet wipe contained within the dispenser is not adequately protected from drying out when the lid is closed.

The present invention overcomes these limitations. The dispenser comprises only two parts—a body for containing the wipes and a lid that covers the wipes dispensing aperture. There are no mechanical parts. A living hinge, which is part of the lid construction, is used for the purpose of opening and shutting the lid. Hence, the dispenser manufacturing process is greatly simplified. Additionally, the dispenser includes a sealing means for preventing evaporation of liquid from the wipes when the lid is in the closed position. Yet further, the lid is designed with a pop-up cover allowing for easy one-handed wipes dispensing without requiring the user to hold the cover in an open position while dispensing a wipe.

SUMMARY OF THE INVENTION

The present invention relates to a dispenser for dispensing wipes. The dispenser comprises a lid which is attached to a body. The lid is constructed of a single unitary piece of material. The lid includes a dispensing aperture and a cover. The cover includes an exterior seal, an inner seal, a perimeter seal comprising a backside perimeter seal, and a locking mechanism. The lid also includes a hinge which connects the cover to the lid. The hinge includes a step, a hinge step contacting member, and a deflection member. The lid also includes an inner ring adjacent to the dispensing aperture. A middle ring is adjacent to the inner ring. An outer ring is adjacent to the middle ring. A lower lid is adjacent to the outer ring. The lower lid includes a depression member. The hinge step contacting member contacts the step creating a first interference resulting in the outward deflection of the deflection member and creating a first storage energy. The backside perimeter seal of the cover contacts the wall formed by the middle ring and the outer ring thereby creating a second interference resulting in additional storage energy. The exterior seal contacts the wall formed by the outer ring and the lid surface. The latch catch engages the locking mechanism.

The dispenser may have an inner ring which includes an outer tapered surface leading to the middle ring. The dispenser may also have an inner seal with a tapered surface. The dispenser may optionally include support ribs.

DETAILED DESCRIPTION OF THE INVENTION

Figure 1:
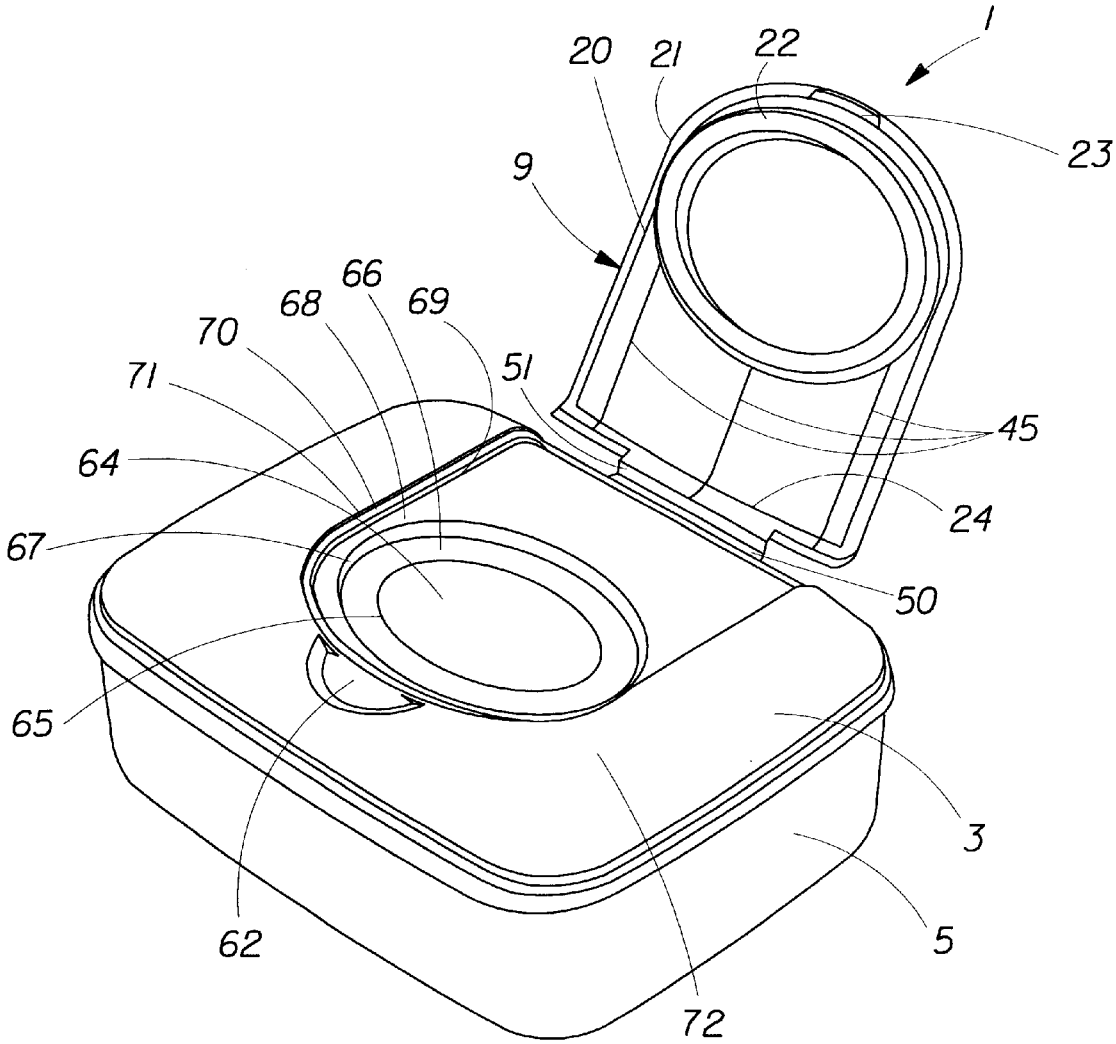
FIG. 1 is an isometric view of one embodiment of the dispenser of this invention.

This invention relates to a dispenser for dispensing wipes. Referring to FIG. 1, the dispenser 1 comprises a lid 3 which is attached to the body 5. The lid 3 comprises a dispensing aperture 64 and a cover 9 which is connected to the lid 3 by a hinge 51. The lid 3 and all its components are constructed from a single unitary piece of material. The lid 3 also includes an inner ring 66 adjacent to the dispensing aperture 64, a middle ring 68 adjacent to the inner ring 66, and an outer ring 70 adjacent to the middle ring 68. The inner ring 66 preferably has an outer tapered surface leading to the middle ring 68.

Figure 6:
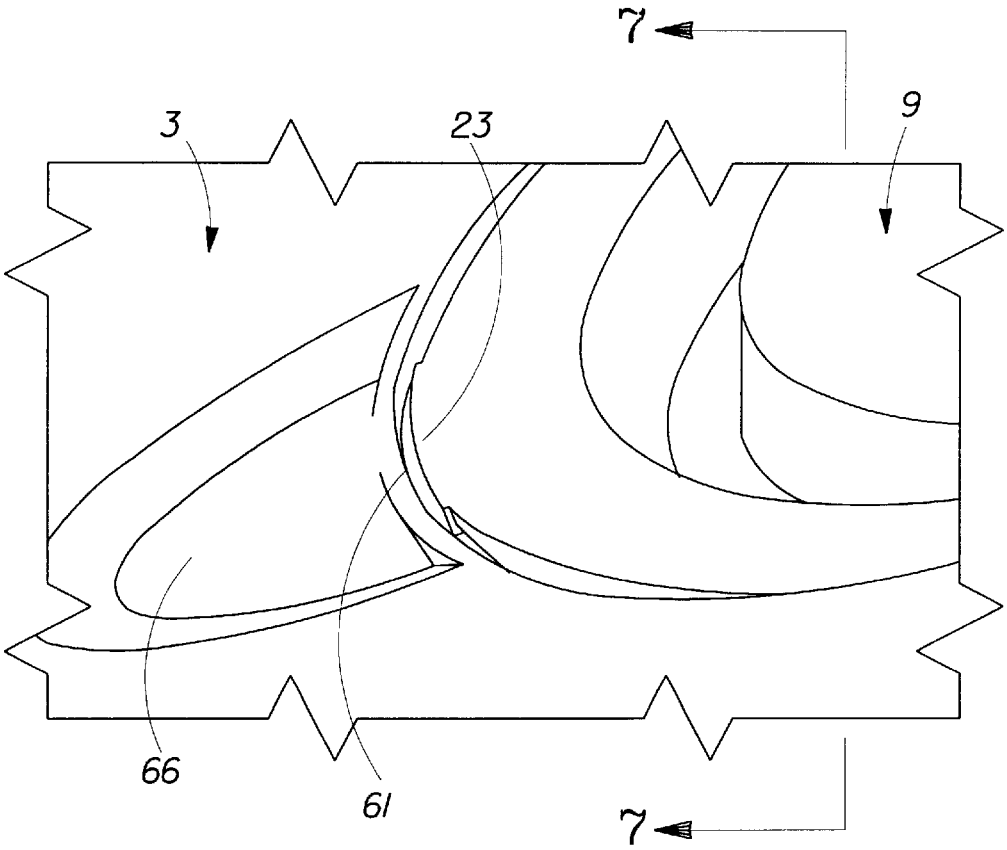
FIG. 6 is a partial top isometric view of the dispenser of FIG. 1 showing the cover in a closed position.

The lower lid 72 is adjacent to the outer ring 70. The lower lid 72 also includes a depression member 62. When the cover 9 is in a closed position such as shown in FIG. 6, the user may release the cover 9 into an open position such as shown in FIGS. 1, 2, 4, and 5, by depressing the depression member 62. This then allows the cover 9 to pop-up.

Referring to FIG. 1, the cover 9 is comprised of a hinge 51. The hinge 51 includes a step 50 and a hinge step contacting member 52. The cover 9 also includes a perimeter seal 20 which comprises a backside perimeter seal 24. The cover 9 further includes an exterior seal 21 and an inner seal 22. Preferably the inner seal 22 has a tapered surface. The cover 9 also includes a locking mechanism 23. Optionally, the cover 9 may include one or more support ribs 45.

Figure 2:
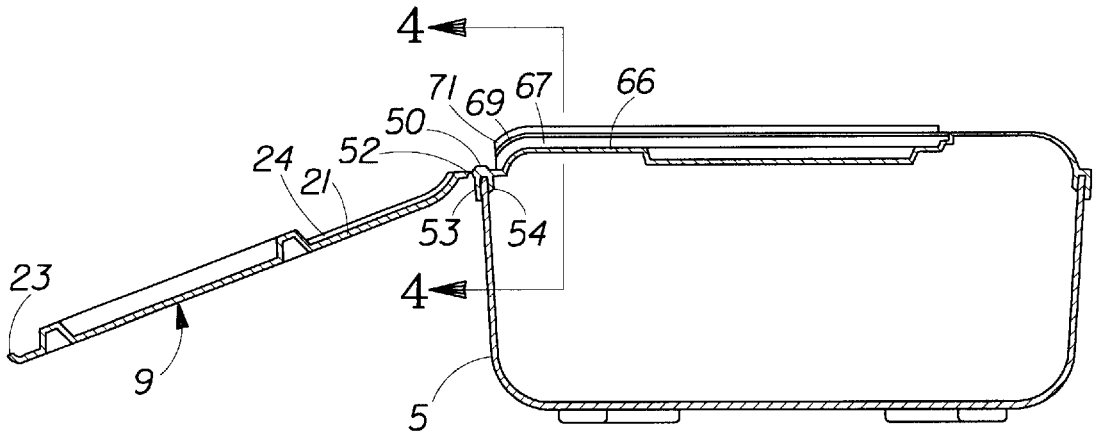
FIG. 2 is a side view of the dispenser of FIG. 1 showing the cover in an open position.
Figure 2A:
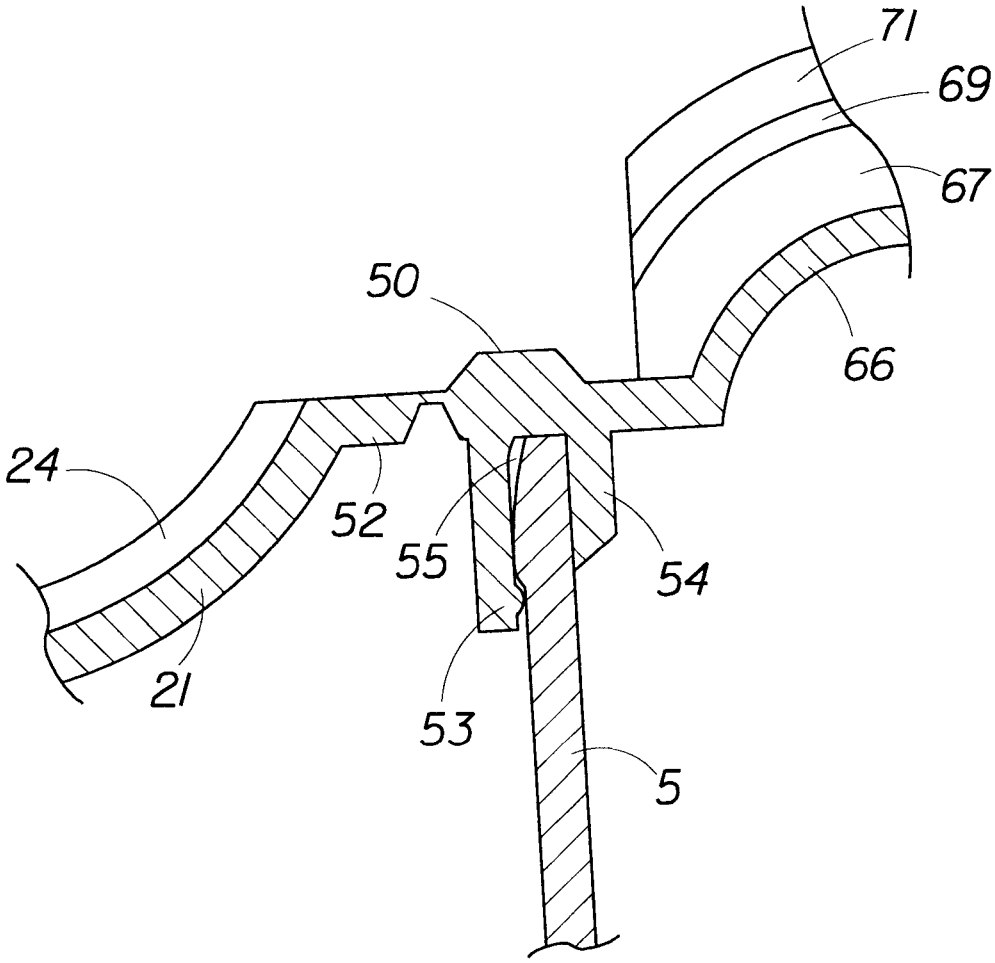
FIG. 2A is a cross-sectional view taken along line 4—4 of FIG. 2.
Figure 2B:
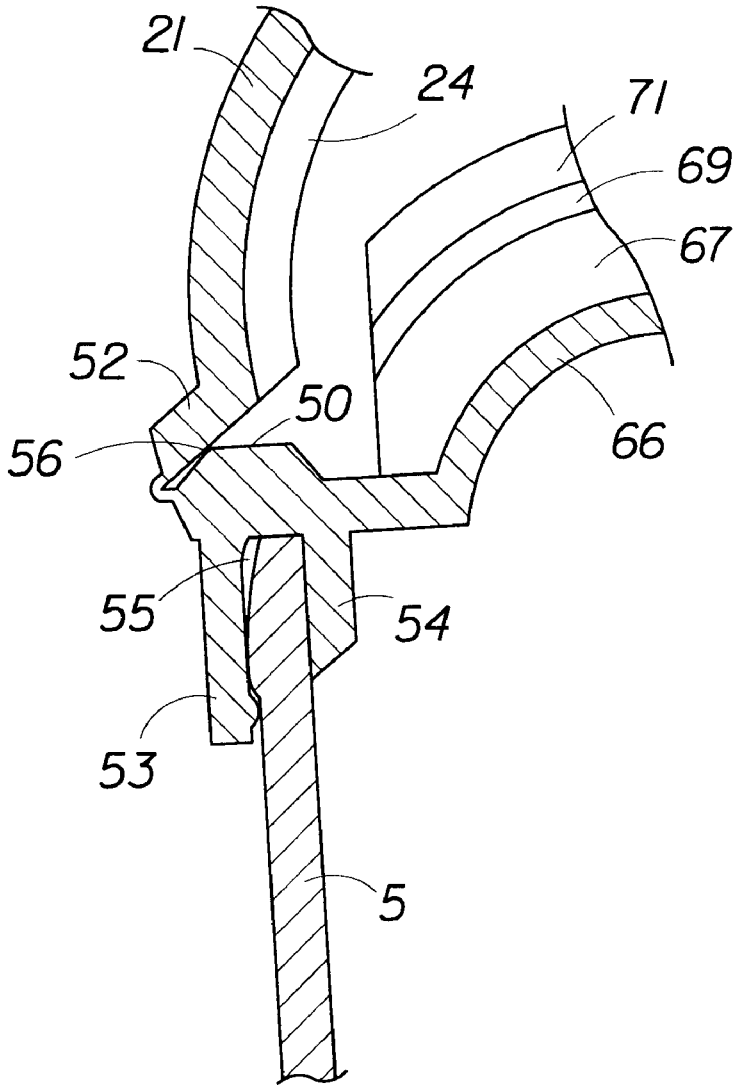
FIG. 2B is a cross-sectional view taken along line 4—4 of FIG. 2.
Figure 2C:
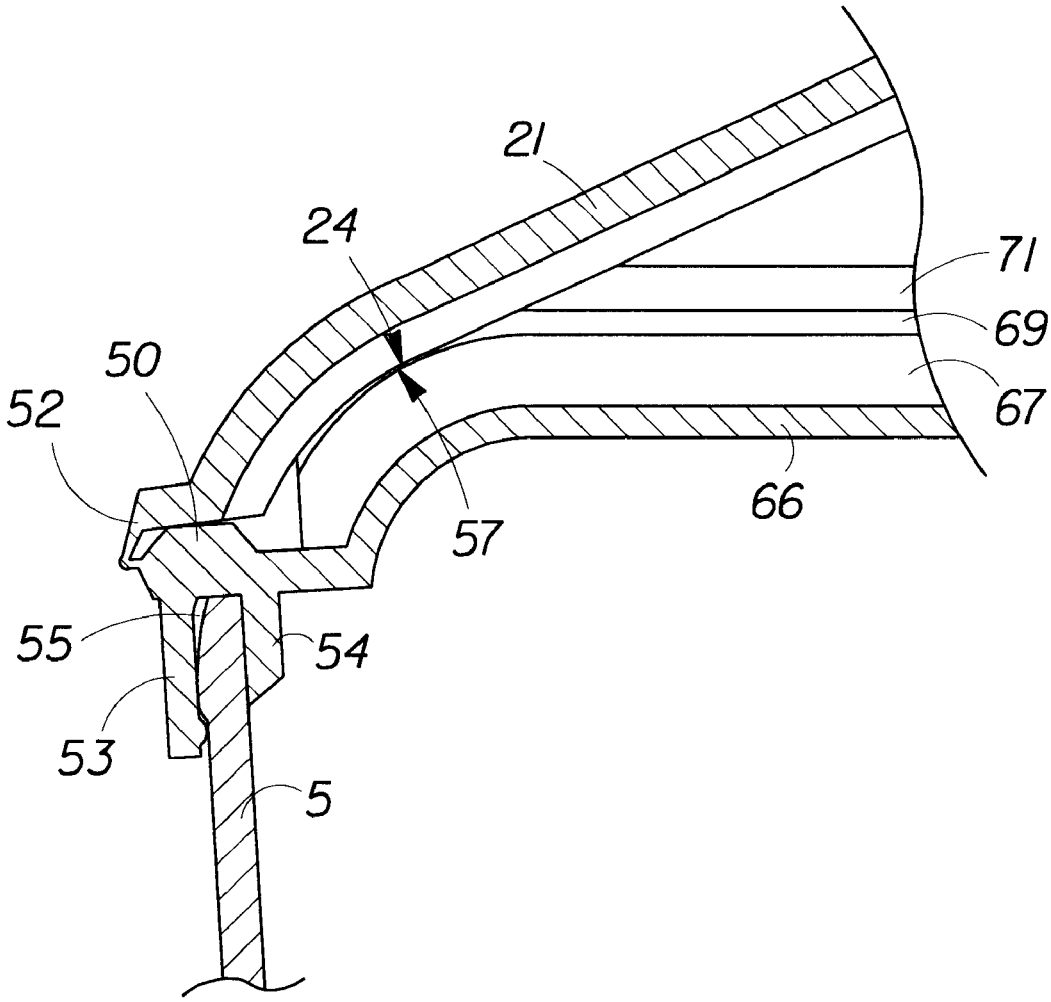
FIG. 2C is a cross-sectional view taken along line 4—4 of FIG. 2.
Figure 3:
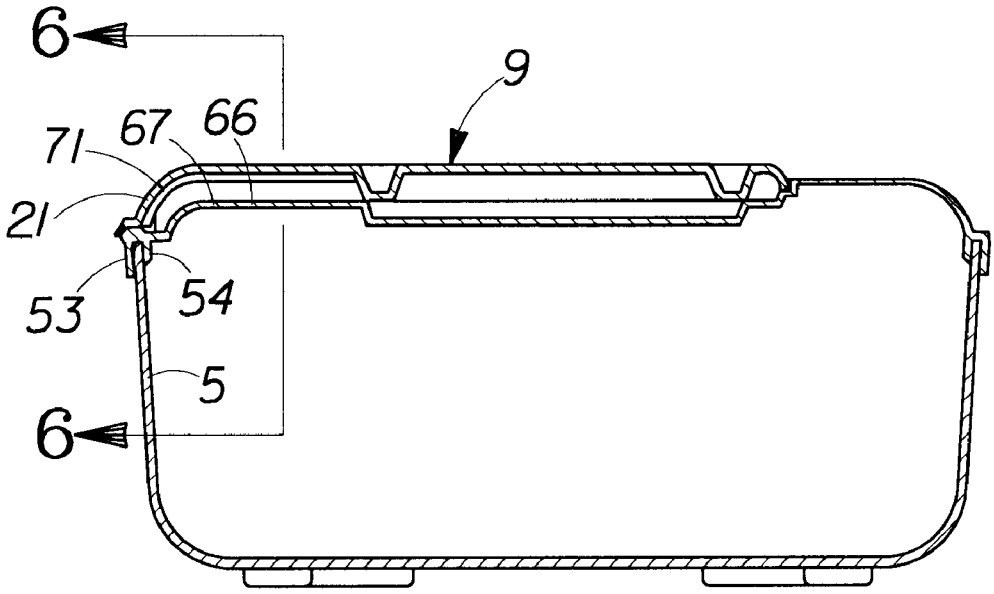
FIG. 3 is a side view of the dispenser of FIG. 1 showing the dispenser cover in a closed position.
Figure 3A:
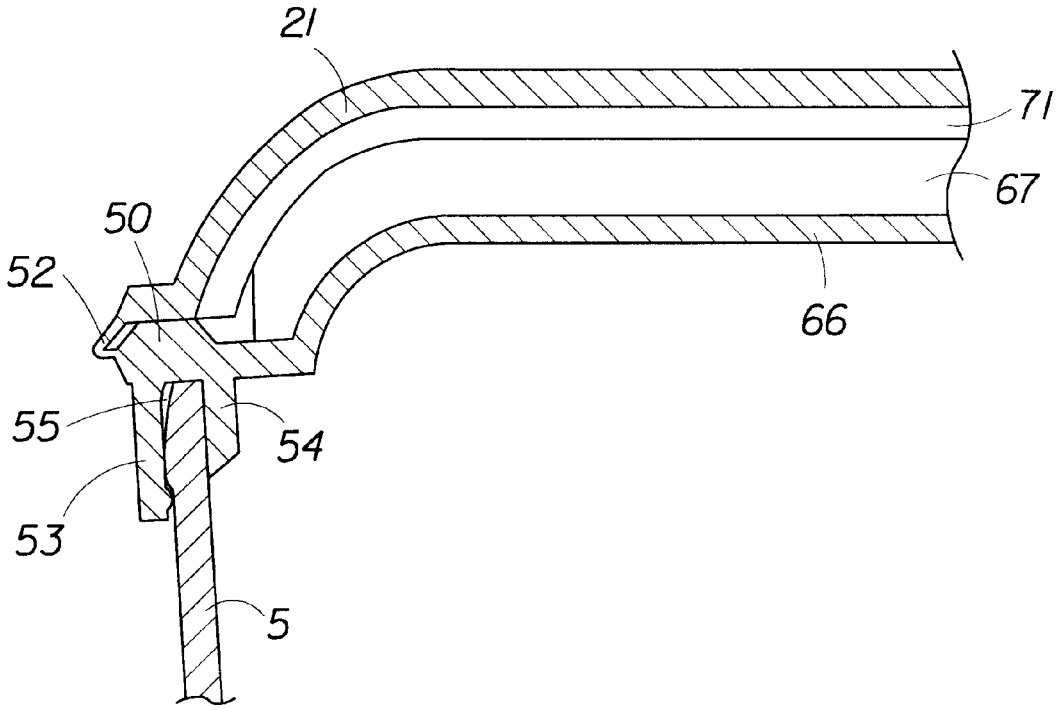
FIG. 3A is a cross-sectional view taken along line 6—6 of FIG. 3.
Figure 4:
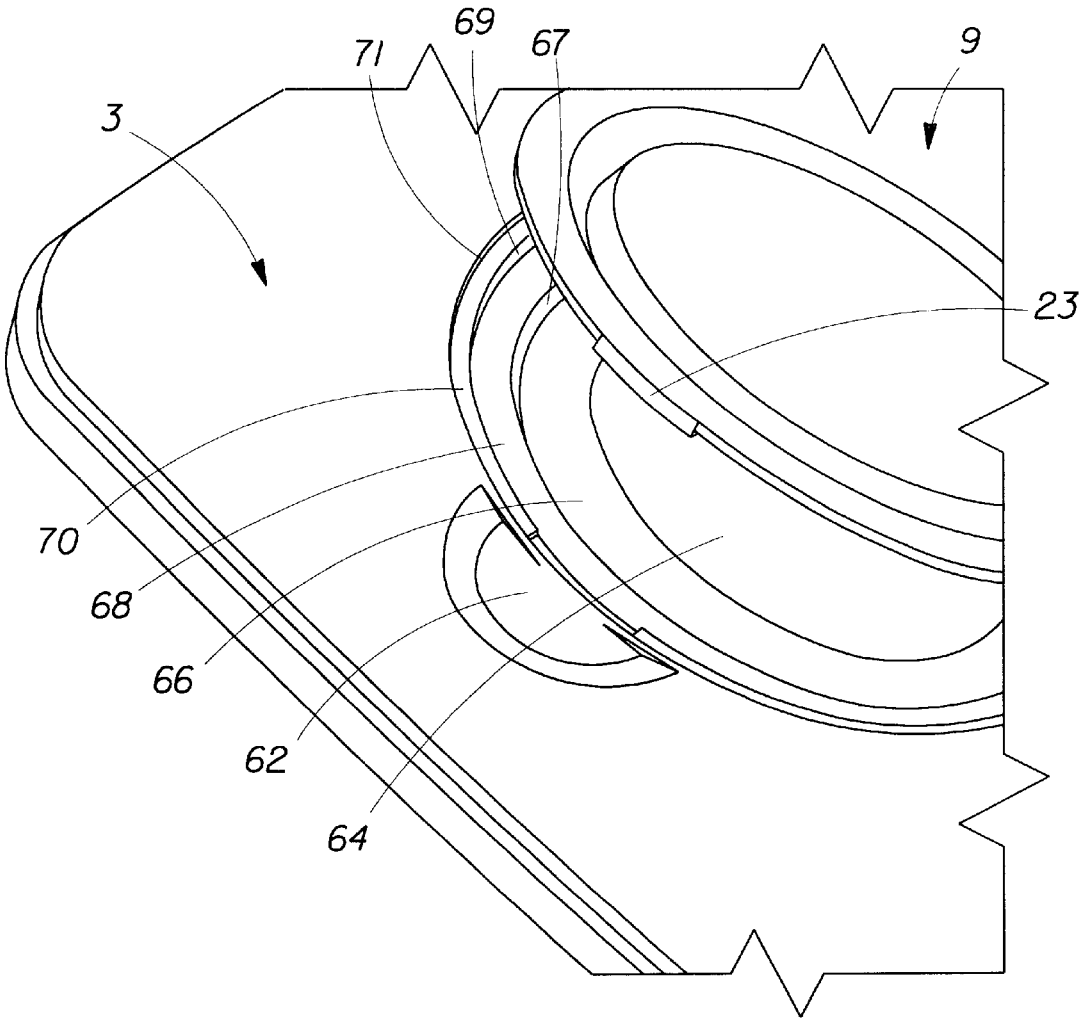
FIG. 4 is a partial top isometric view of the dispenser of FIG. 1.
Figure 5:
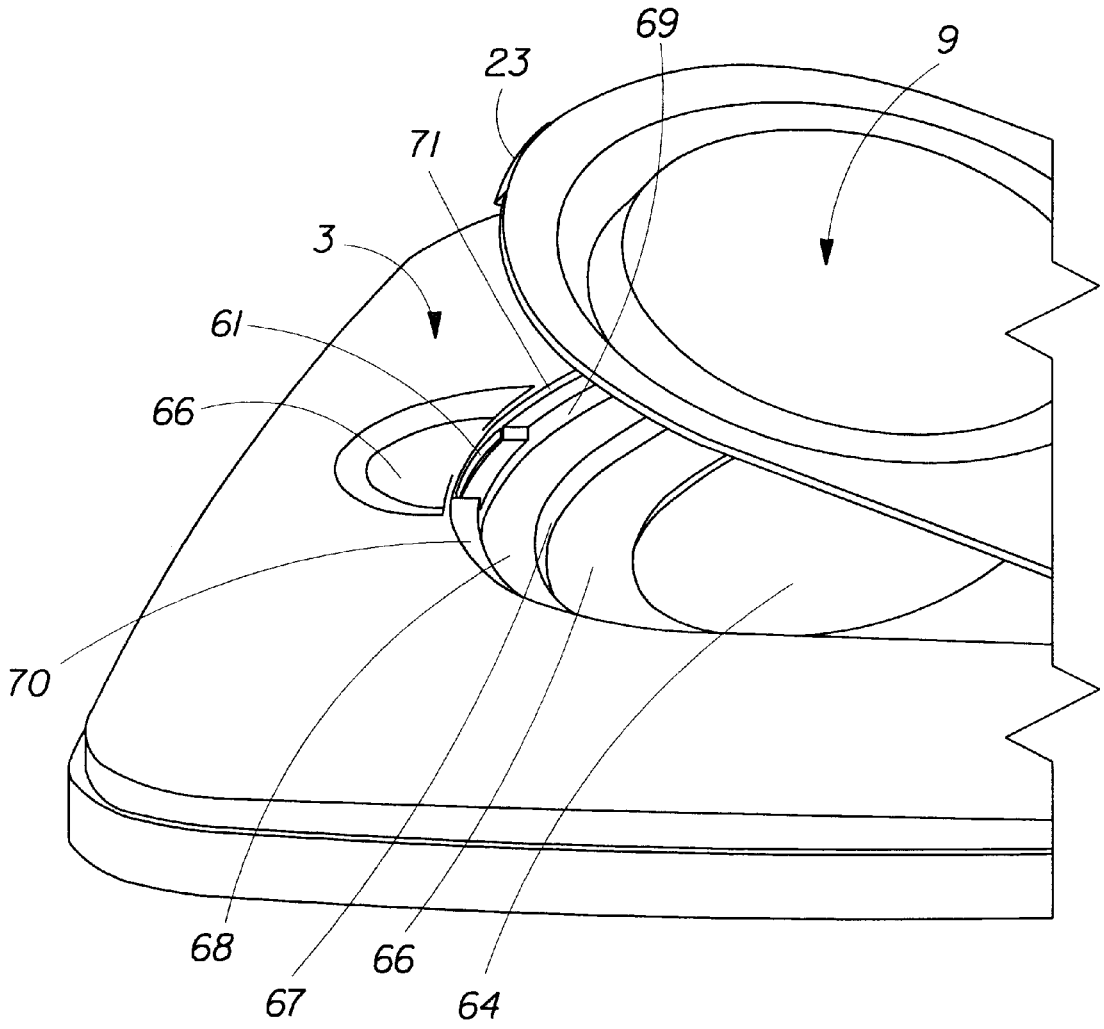
FIG. 5 is a partial side isometric view of the dispenser of FIG. 1.
Figure 6A:
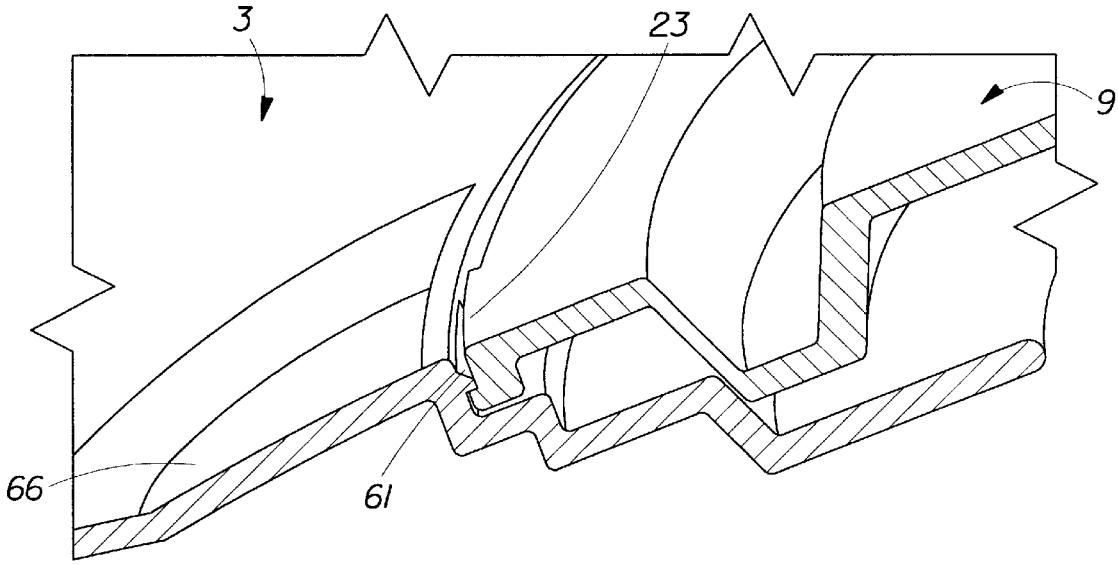
FIG. 6A is a cross-sectional view taken along line 7—7 of FIG. 5.

While not wishing to be limited by theory, it is believed that the pop-up feature of the cover 9 works by the following mechanism. Referring to FIGS. 2, 2A, 2B, and 2C, as a user begins to close cover 9 the hinge step contacting member 52 contacts the step 50. Referring to FIG. 2B, this creates a first interference 56 which results in the outward deflection of the deflection member 53. This first interference 56 creates a first storage energy. Referring to FIG. 2C, as the user continues to close the cover 9, a second interference 57 is created when the backside perimeter seal 24 of the cover 9 comes into contact with the wall 69 formed by the middle ring 68 and outer ring 70. This second interference 57 creates additional storage energy. As shown in FIGS. 3A, 6, and 6A, the cover 9 is fully closed and sealed when the exterior seal 21 contacts the wall 71 formed by the outer ring 70 and lid surface 72 and the latch catch 61 engages the locking mechanism 23. This creates a seal around the dispensing aperture 64 thereby preventing the loss of moisture from the wipes.

Optionally, one or more ribs 45 may be used as structural support for the cover 9 as shown in FIG. 1. As a user depresses the depression member 62, the storage energy is released thereby permitting the cover 9 to pop-up.

A suitable dispenser 1 for the present invention can be produced by injection molding or any other suitable technique familiar to those of ordinary skill in the art. A non-limiting suitable material of construction for the dispenser includes a plastic such as polypropylene. A suitable polypropylene includes a polypropylene having a melt flow rate of 1.9. One such polypropylene is sold as PP TR375 and commercially available from Equistar Chemicals LP of Houston, Tex.

While particular embodiments of the invention have been illustrated and described, it would be obvious to those skilled in the art that various changes and modifications can be made without departing from the scope and spirit of the invention.

What is claimed is:

1. A dispenser for dispensing wipes said dispenser comprising, a lid which is attached to a body, said lid constructed of a single unitary piece of material said lid comprising:

a) a dispensing aperture;

b) a cover, said cover including an exterior seal, an inner seal, a perimeter seal comprising a backside perimeter seal, and a locking mechanism;

c) a hinge which connects said cover to said lid, said hinge including a step, a hinge step contacting member, and a deflection member, d) an inner ring adjacent said dispensing aperture;

e) a middle ring adjacent said inner ring;

f) an outer ring adjacent said middle ring;

g) a lower lid adjacent to said outer ring, said lower lid including a depression member;

whereby said hinge step contacting member contacts said step creating a first interference resulting in the outward deflection of said deflection member and creating a first storage energy, said backside perimeter seal of said cover contacting said wall formed by said middle ring and said outer ring thereby creating a second interference resulting in additional storage energy, said exterior seal contacting said wall formed by said outer ring and said lid surface, and said latch catch engages said locking mechanism.

2. The dispenser of claim 1 wherein said inner ring has an outer tapered surface leading to said middle ring.

3. The dispenser of claim 1 wherein said inner seal has a tapered surface.

4. The dispenser of claim 1 wherein said dispenser is injection molded.

5. The dispenser of claim 4 wherein said dispenser comprises polypropylene.

6. The dispenser of claim 5 wherein said polypropylene has a melt flow rate of 1.9.

7. The dispenser of claim 1 further comprising support ribs.

* * * * *